US005975745A

United States Patent [19]

Oishi et al.

[11] Patent Number: 5,975,745

[45] Date of Patent: Nov. 2, 1999

[54] METHOD OF AND APPARATUS FOR MEASURING CURL OF WEB, METHOD OF AND APPARATUS FOR CORRECTING CURL OF WEB, AND APPARATUS FOR CUTTING WEB

[75] Inventors: Hirohiko Oishi; Kazuo Horiuchi; Hisayoshi Kobayashi, all of Shizuoka-ken, Japan

[73] Assignee: Fuji Photo Film Co., Ltd., Kanagawa-ken, Japan

[21] Appl. No.: 08/783,895

[22] Filed: Jan. 16, 1997

[30] Foreign Application Priority Data

Jan. 17, 1996 [JP] Japan ..... 8-006142

[51] Int. Cl.[6] ..... G06F 19/00; G06G 7/66

[52] U.S. Cl. ..... 364/474.09; 364/470.01; 83/365

[58] Field of Search ..... 364/474.01, 474.07, 364/474.09, 474.1, 472.04, 472.05, 472.06; 83/365

[56] References Cited

U.S. PATENT DOCUMENTS

| | | | |
|---|---|---|---|
| 3,799,038 | 3/1974 | Bossons et al. | 93/1 |
| 4,548,110 | 10/1985 | Reil | 83/176 |
| 4,757,732 | 7/1988 | Arima | 83/425.2 |
| 4,944,503 | 7/1990 | Arima | 270/95 |
| 5,687,595 | 11/1997 | Noe et al. | 72/8.3 |

FOREIGN PATENT DOCUMENTS

| | | |
|---|---|---|
| 0 374 827 | 6/1990 | European Pat. Off. . |
| 2 695 049 | 3/1994 | France . |
| 6-050751 | 2/1994 | Japan . |
| 6-50751 | 2/1994 | Japan . |

OTHER PUBLICATIONS

Japanese Abstract translated into English, JP 06 050751, dated Feb. 25, 1994.

*Primary Examiner*—William Grant
*Assistant Examiner*—Peter W. Eissmann
*Attorney, Agent, or Firm*—Sughrue, Mion, Zinn, Macpeak & Seas, PLLC

[57] ABSTRACT

A web cutting apparatus has a decurling unit for correcting curl of a web unwound from a reel while the web is being fed, a slitter for slitting the web, a cutter for cutting the web into successive sheets each having a predetermined length, a curl measuring unit disposed at an exit end of the runner cutter, and a conveyor for conveying the sheets to a stacker station. The curl measuring unit has a cut completion detecting mechanism for detecting when the web is cut by the cutter, a cutter distance measuring mechanism for detecting the position of the cutter, and a web displacement measuring mechanism for detecting a displacement due to a bend of a free distal end of the web.

20 Claims, 14 Drawing Sheets

(UNWINDING SPEED: 20 m/min.)

CUT COMPLETION DETECTOR 52
ON
OFF
TIME (mm)
-30
-20
-10
0
10
20
30
CUTTER DISTANCE MEASURING UNIT 54
TIME (mm)
-10
0
10
20
30
WEB DISPLACEMENT MEASURING UNIT 56
TIME
(UNWINDING SPEED: 90 m/min.)

METHOD OF AND APPARATUS FOR MEASURING CURL OF WEB, METHOD OF AND APPARATUS FOR CORRECTING CURL OF WEB, AND APPARATUS FOR CUTTING WEB

BACKGROUND OF THE INVENTION

1. Field of the Invention

The present invention relates to a method of and an apparatus for measuring curl of a web which is fed in its longitudinal direction, a method of and an apparatus for correcting curl of such a web, and an apparatus for cutting such a web.

2. Description of the Related Art

Generally, presensitized plates for planographic printing have a support layer coated with a photosensitive material and comprising a thin metal sheet of aluminum, for example, which has a thickness ranging from 0.1 mm to 0.5 mm, for example. A web cutting apparatus for cutting a web into such thin metal sheets for use in presensitized plates has a reel which supports a roll of web. The web unwound from the web roll on the reel is corrected out of curling into a flat shape by a curl correcting apparatus such as a decurling unit or a roller leveler. The decurled web is then trimmed by a slitter and cut by a shear into sheets which are delivered by a feed mechanism such as a conveyor to a stacker section where they are stacked.

In the web cutting apparatus, sheets cut from the web are inspected for curl or shape defects. For example, sheets cut by the shear are sampled on a production line, and the sampled sheet is measured in an off-line area for curl or shape defects (hereinafter referred to as "prior art 1"). Japanese Laid-Open Patent Publication No. 6-50751 discloses a process for detecting the amount of a bend (curl) in the leading end of a cut sheet at the exit end of a conveyor as a feed mechanism (hereinafter referred to as "prior art 2").

According to the prior art 1, a sheet on the production line is removed by a sampling unit and then measured in the off-line area for curl or shape defects. The measuring process requires a considerable amount of manual work which is time-consuming. Since the production line is shut off until the measuring process is finished, the production line is poor in efficiency.

According to the prior art 2, the amount of a bend in the leading end of a cut sheet is detected after the sheet is delivered to the exit end of the conveyor. As a plurality of defective sheets may possibly be present between a curl correcting unit and the exit end of the conveyor, the yield of normal sheets is relatively poor.

Settings for a curl correcting unit for correcting curl in sheets are changed usually depending on the experience of the operator. Therefore, the number of sheets which are rejected as being defective varies from operator to operator. The web wound around the reel has different amounts of curl at the outer periphery of the roll than near the reel of the roll. The settings for the curl correcting unit must be different at the outer periphery of the roll than near the reel. The settings for the curl correcting unit for decurling the web in the vicinity of the reel are changed based on the experience of the operator. This practice imposes an undue burden on the operator. If settings for the curl correcting unit are changed inappropriately, then cut sheets tend to become tortuous on the conveyor and to be stacked improperly. As a result, the yield of proper sheets is poor, and the efficiency of the production line is low.

When another web unwound from a web roll on the reel is cut into sheets for use in new presensitized plates, the curl correcting unit is first operated with provisional settings. Then, the provisional settings are modified into final settings based on the results of an inspection process conducted on the sheets for curling. Until the final settings are determined, the production line is operated with the provisional settings, which results in the possibility of a low product yield. To avoid the possibility of a low product yield, it is necessary to operate the production line at a low speed until the final settings are determined. As a consequence, the rate of production of sheets for use in presensitized plates is relatively low.

SUMMARY OF THE INVENTION

It is a general object of the present invention to provide a method of and an apparatus for measuring the amount of curl of a web quickly and accurately on a production line.

A principal object of the present invention is to provide a method of and an apparatus for correcting the curl of a web with accurate settings which are changed based on the amount of curl, thereby to produce product sheets at a high yield.

Another principal object of the present invention is to provide an apparatus for cutting a web into sheets, which has a curl correcting unit whose settings can efficiently and accurately be established based on the amount of curl in the web, thereby to produce product sheets at a high yield.

BRIEF DESCRIPTION OF THE DRAWINGS

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
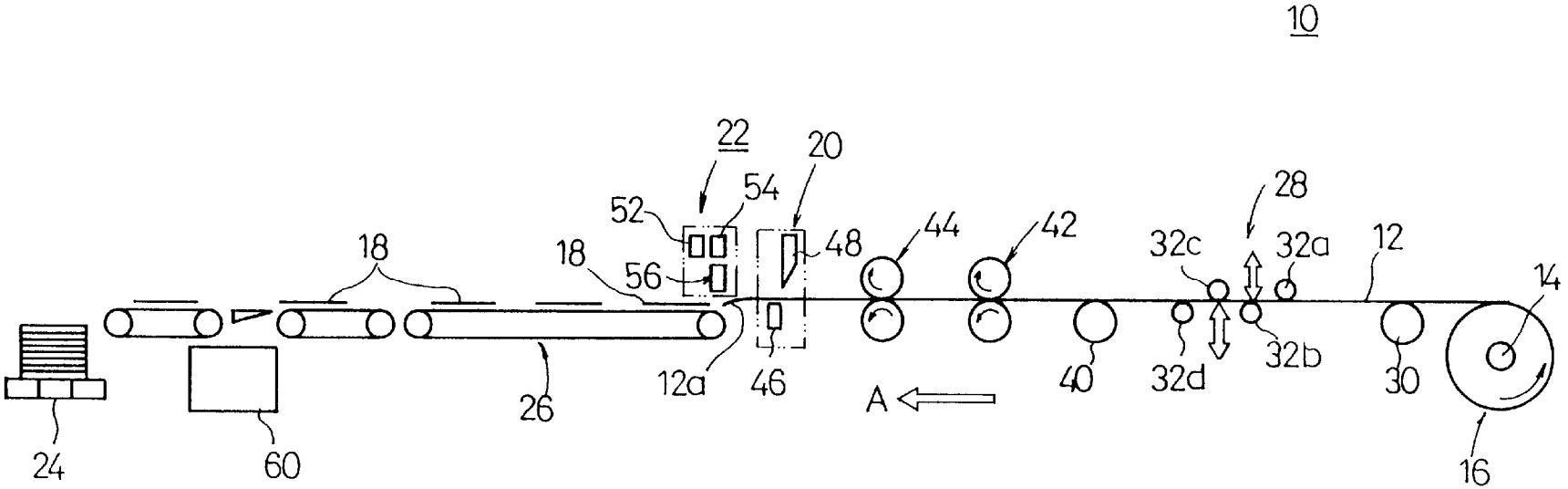
FIG. 1 is a schematic side elevational view of a web cutting apparatus according to a first embodiment of the present invention.

FIG. 1 schematically shows a web cutting apparatus 10 according to a first embodiment of the present invention. The web cutting apparatus 10 shown in FIG. 1 serves to cut a web 12 coated with a photosensitive material into sheets for use in presensitized plates for planographic printing.

As shown in FIG. 1, the web cutting apparatus 10 generally comprises an unwinder 16 having a reel 14 on which the web 12 is wound as a roll, a running shear for cutting off the web 12 unwound from the reel 14 into sheets 18 each of a predetermined length, and a curl measuring unit 22 disposed at an exit end of the running shear 20 downstream thereof in the direction indicated by the arrow A, for measuring the amount of curl of the web 12 based on a displacement due to a bend of a leading end 18*a* (see FIG. 7) of each of the sheets 18, and a conveyor (feed mechanism) 26 for delivering the sheets 18 to a stacker station (stacking position) 24.

Between the unwinder 16 and the running shear 20, there is disposed a decurling unit 28 serving as a curl correcting unit for correcting curl of the web 12 as it is unwound from the reel 14.

Figure 2:
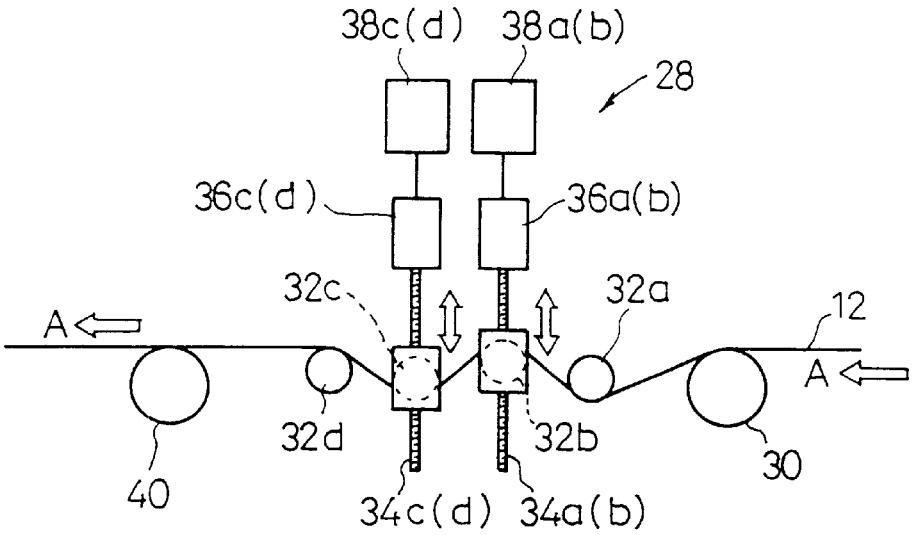
FIG. 2 is an enlarged side elevational view of a decurling unit of the web cutting apparatus according to the first embodiment.

The unwinder 16 has a rotary drive source (not shown) for rotating the reel 14 counterclockwise in the direction indicated by the arrow thereby to feed the web 12 in the direction indicated by the arrow A toward the decurling unit 28. A roller 30 for supporting the web 12 thereon is positioned closely to the unwinder 16. The decurling unit 28, which is positioned near and downstream of the roller 30, has a plurality of decurl rollers 32*a*–32*d* as shown in FIGS. 1 and 2. The decurl rollers 32*a*–32*d* have a diameter smaller than the diameter of the roller 30 and ranging from 30 mm to 80 mm.

Figure 3:
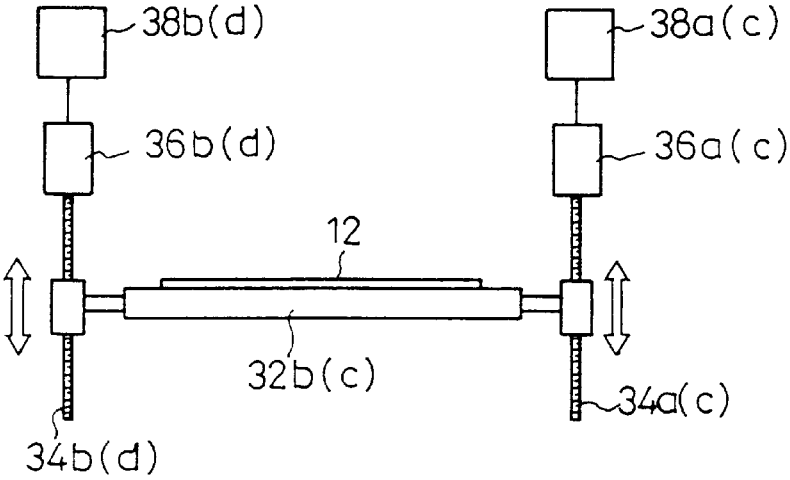
FIG. 3 is a front elevational view of the decurling unit shown in FIG. 3.

As shown in FIGS. 2 and 3, vertical ball screws 34*a*–34*d* are threaded in opposite ends of the decurl rollers 32*b*, 32*c*, and have upper ends coupled to drive mechanisms such as motors 36*a*–36*d*, respectively, for vertically displacing the decurl rollers 32*b*, 32*c* to change settings of the decurling unit 28. Control units (control mechanisms) 38*a*–38*d* are electrically connected respectively to the motors 36*a*–36*d* for individually controlling the motors 36*a*–36*d*.

As shown in FIG. 1, a roller 40 and a pair of feed rollers 42 are disposed downstream of the decurling unit 28. The feed rollers 42 are rotatable in the respective directions indicated by the arrows by a drive motor (not shown) for delivering the web 12 in the direction indicated by the arrow A. A slitter 44 which is disposed downstream of the feed rollers 42 has a pair of slitter blades 45 (see FIG. 4) for cutting the web 12 to a predetermined width, i.e., cutting the web 12 into a plurality of longitudinal web sections.

The running shear 20, which is positioned downstream of the slitter 44, comprises a lower blade 46 and an upper blade 48. While moving back and forth along the direction indicated by the arrow A with an actuator 50 (see FIG. 5) including a drive motor (not shown), the running shear 20 cuts the web 12 into sheets 18 with the lower blade 46 and the upper blade 48.

The curl measuring unit 22 has a cut completion detector (cut completion detecting mechanism) 52 for detecting when the web 12 is cut by the running shear 20, a cutter distance measuring unit (cutter distance measuring mechanism) 54 for detecting the position of the running shear 20, and a web displacement measuring unit (web displacement measuring mechanism) 56 for detecting a displacement due to a bend of a free leading end 12*a* (see FIG. 7) of the web 12 as a change in the distance up to the surface of the web 12.

Figure 4:
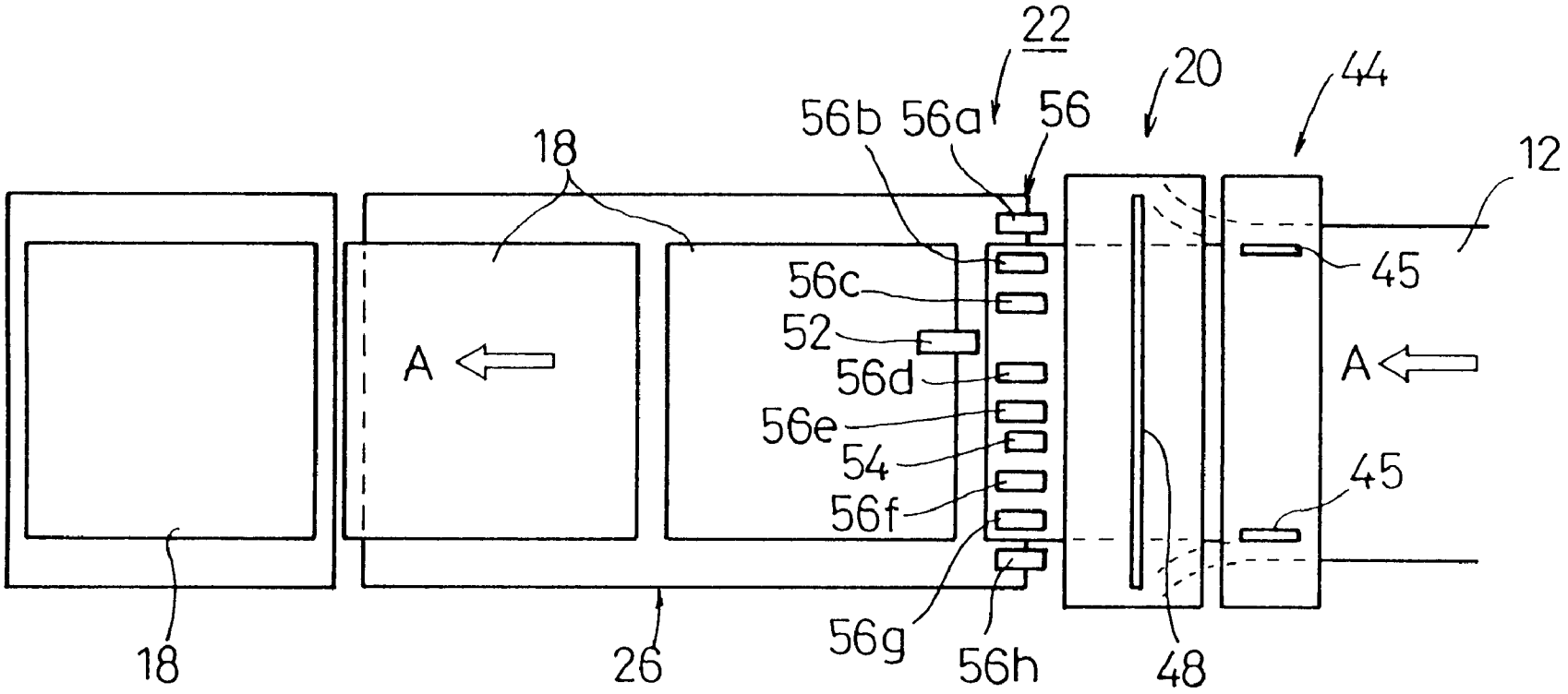
FIG. 4 is a plan view of the web cutting apparatus according to the first embodiment.
Figure 5:
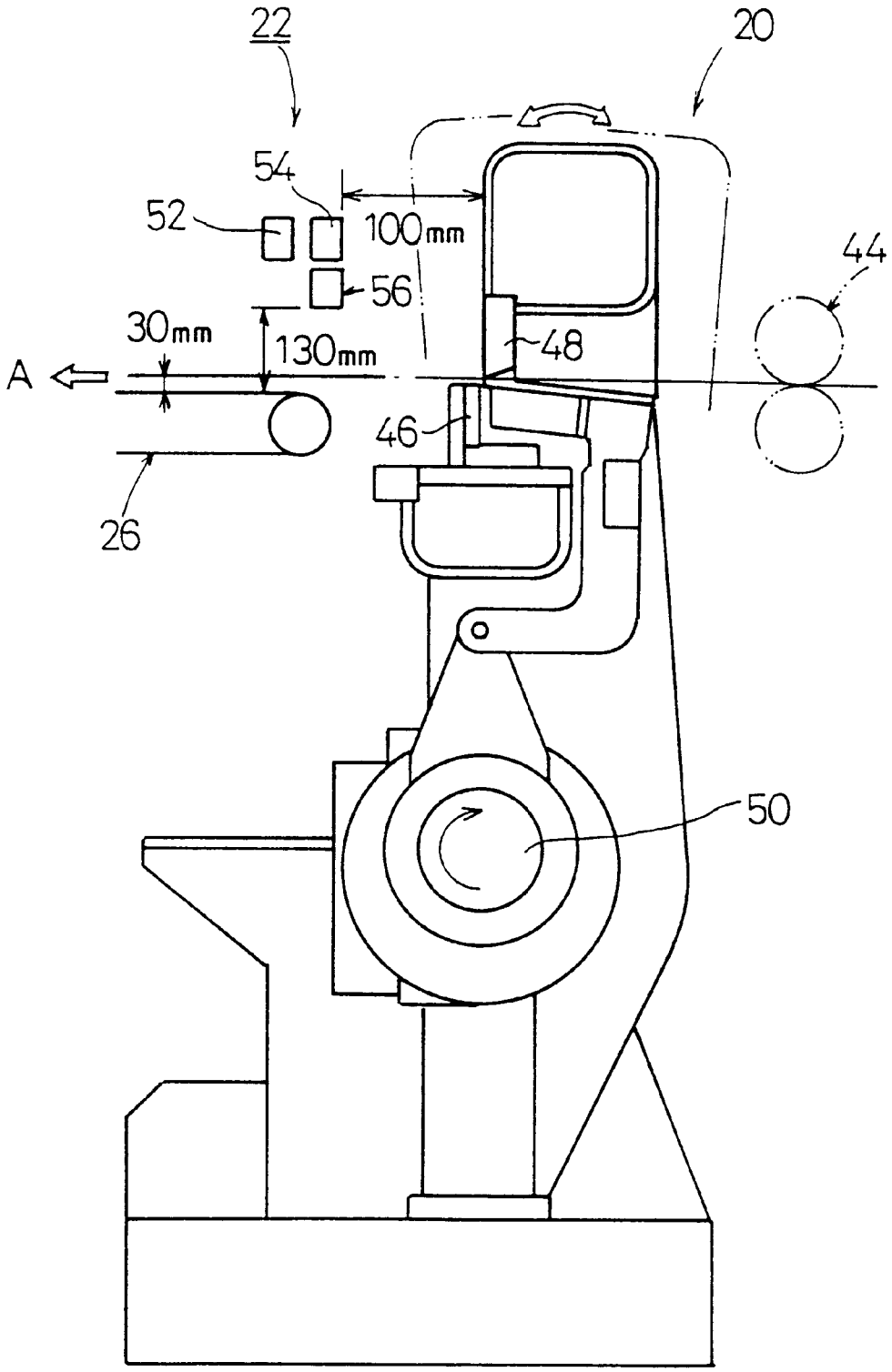
FIG. 5 is a side elevational view of a running shear of the web cutting apparatus according to the first embodiment.

As shown in FIGS. 4 and 5, the cut completion detector 52 and the cutter distance measuring unit 54 are positioned to detect the position of a lateral side of the running shear 20. As shown in FIG. 4, the web displacement measuring unit 56 comprises a plurality of, e.g., eight, web displacement measuring elements 56*a*–56*h* which are arrayed transversely across the web 12 and can be switched to output signals.

Each of the cutter distance measuring unit 54 and the web displacement measuring elements 56*a*–56*h* comprises a laser beam displacement meter. Each of the web displacement measuring elements 56*a*–56*h* has a semiconductor laser for emitting a laser beam, having a wavelength of 780 nm, to the web 12 which has been coated with a photosensitive material. The cut completion detector 52 comprises a photoelectric switch including a light-emitting element for emitting an infrared ray to the web 12 and a light-detecting element.

As shown in FIG. 1, a defective sheet discharger 60 is disposed in a position somewhere along the conveyor 26. The stacker station 24 is disposed at a terminal end of the conveyor 26 for stacking sheets 18 discharged from the conveyor 26.

Figure 6:
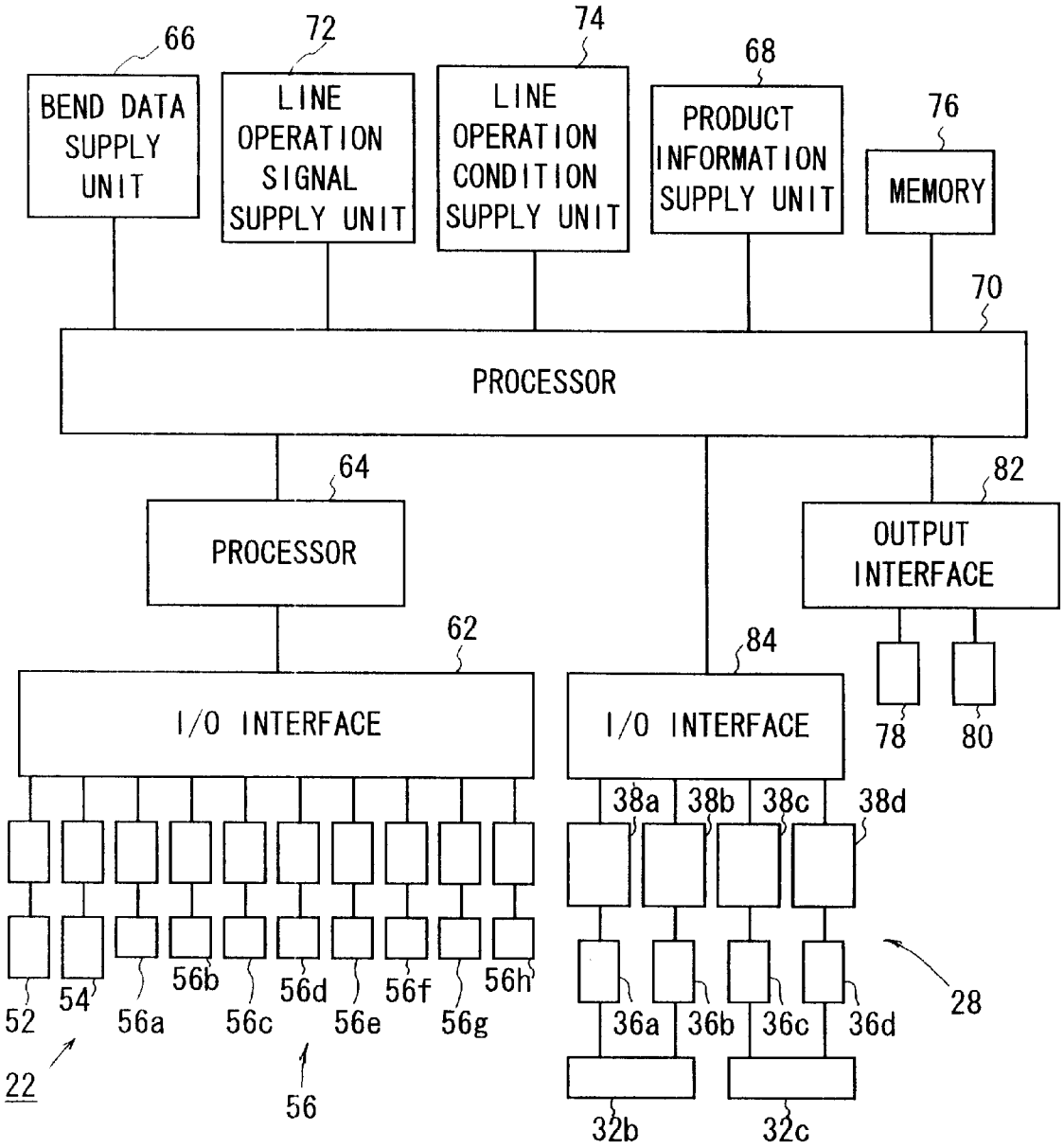
FIG. 6 is a block diagram of a control system for the web cutting apparatus according to the first embodiment.

As shown in FIG. 6, the curl measuring unit 22 comprises a processor 64 for calculating the amount of a bend of the web 12 based on signals supplied from the cut completion detector 52, the cutter distance measuring unit 54, and the web displacement measuring elements 56*a*–56*h* through an input/output interface 62, and a processor 70 for calculating the amount of curl of the web 12 based on a calculated result from the processor 64, a signal from a bend data supply unit 66, and a signal from a product information supply unit 68. To the processor 70, there are also electrically connected a line operation signal supply unit 72, a line operation condition supply unit 74 for supplying a signal representative of operating conditions of the web cutting apparatus 10, etc., a memory 76 for storing the calculated amount of curl and roller settings for the decurling unit 28, an output interface 82 for outputting the calculated amount of curl to a display unit 78 and an alarm unit 80, and an input/output interface 84 for inputting signals to and outputting signals from the control units 38*a*–38*d* of the decurling unit 28.

The bend data supplied from the supply unit 66 include data with respect to the amount of a bend of the leading edge 12*a* and the amount of curl of the web 12, which have been measured in advance. The amount of curl of the web 12 is determined using the relationship (described later on) between these amounts of the bend and curl. The product information supplied from the product information supply unit 68 represents thicknesses, widths, cut lengths, and types of webs 12 which correspond to various sheet products.

Operation of the web cutting apparatus 10 will be described below with respect to a method of measuring curl and a method of correcting curl according to the first embodiment of the present invention.

The web 12 comprises a thin aluminum sheet (JIS alloy No. 1050) having a thickness of 0.24 mm and a width of 1060 mm. The web 12 is unwound from the reel 14 at two speeds of 20 m/min and 90 m/min. Each of the decurl rollers 32*a*–32*d* of the decurling unit 28 has a diameter of 60 mm. The web 12 is trimmed by the slitter 44 to a width of 1030 mm. The web 12 is cut by the running shear 20 into sheets 18 each having a length of 800 mm. The cut sheets 18 are discharged from the running shear 20 at a height of 30 mm above the conveyor 26.

The web displacement measuring elements 56*a*–56*h* are arranged in a pattern that is symmetrical with respect to the center of the direction in which the web 12 is delivered by the conveyor 26, as shown in FIG. 4. The distance between the web displacement measuring elements 56*d*, 56*e* is set to 60 mm, the distance between the web displacement measuring elements 56*c*, 56*f* is set to 750 mm, the distance between the web displacement measuring elements 56*b*, 56*g* is set to 970 mm, and the distance between the web displacement measuring elements 56*a*, 56*h* is set to 1230 mm.

A diagram which represents the relationship between the amount of a bend of the leading end 12*a* and the amount of curl of the web 12, which have been measured in advance, is shown in Table 1. Specifically, as shown in Table 1 below, a sheet 18, which has been cut off to a given dimension from the rolled web 12 with its upper surface coated with a photosensitive material, is placed on a reference plate 90, and the amount of a lift of edges of the sheet 18 is measured with a height gage or the like.

TABLE 1

| | |
|---|---|
| 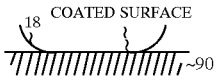  | (−) CURL |
| 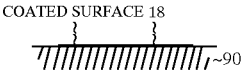  | (0) CURL |

TABLE 1-continued

| | |
|---|---|
| 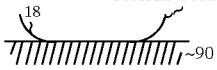  | (+) CURL |

Specifically, when the sheet 18 is placed on the reference plate 90 with the coated surface facing upward, any upward lift of edges of the sheet 18 is represented by "(−) curl". When the sheet 18 is placed on the reference plate 90 with the coated surface facing downward, any upward lift of edges of the sheet 18 is represented by "(+) curl".

Figure 7:
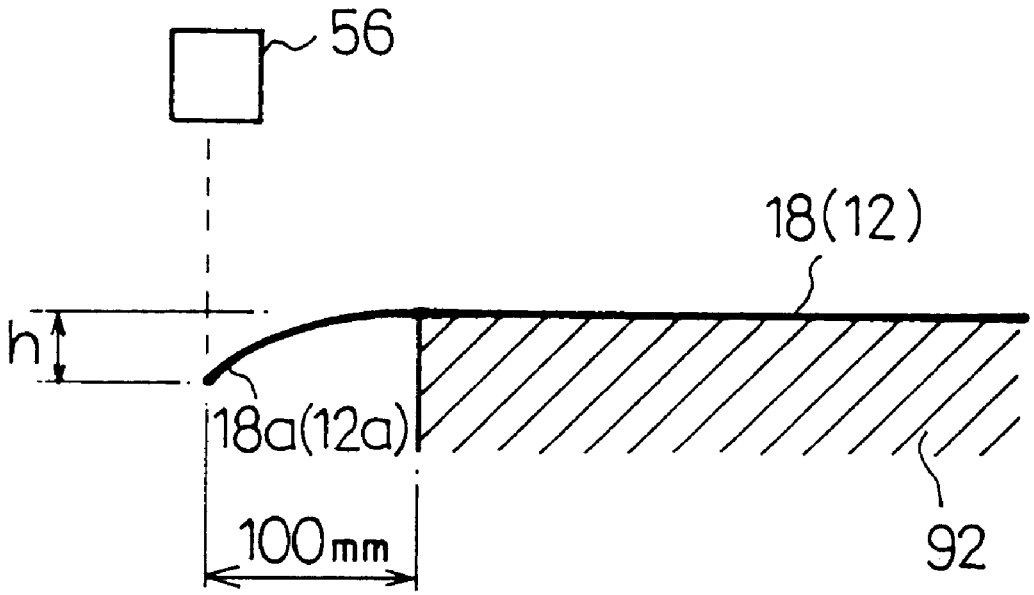
FIG. 7 is a schematic view illustrative of a method of measuring curl.

The relationship between the amount of curl of the web 12 and the amount of a bend of the leading end 12*a* is equivalent to the relationship between the amount of a lift of an edge of the sheet 18 and the amount of a bend of the leading end 18*a* of the sheet 18. As shown in FIG. 7, the sheet 18 is placed on the reference plate 92 with the leading end 18*a* projecting forward from an end of the reference plate 92, and the distance "h" of the leading end 18*a* from the upper surface of the reference plate 92 is measured as the amount of a bend of the leading end 18*a* by a height gage while at the same time the output signal from the web displacement measuring unit 56 is stored. The sheet 18 has a thickness of 0.24 mm, and the amount of a bend of the leading end 18*a* of the sheet 18 is measured while the leading end 18*a* is bending about a fulcrum that is 100 mm spaced from the leading end 18*a*.

Figure 8:
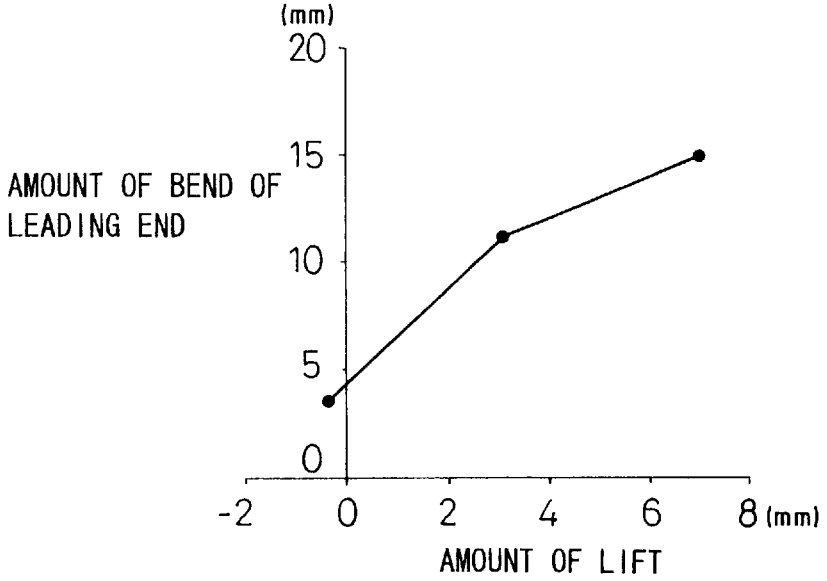
FIG. 8 is a diagram showing the relationship between the amount of a lift and the amount of a bend of a leading end in the method of measuring curl.
Figure 9:
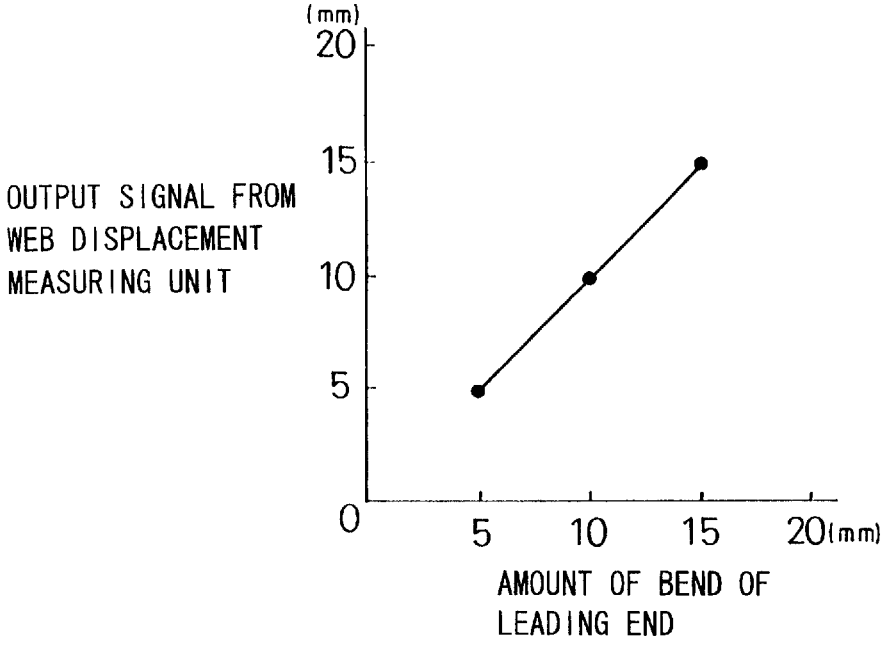
FIG. 9 is a diagram showing the relationship between the amount of a bend of a leading end and the output signal of a web displacement measuring unit in the method of measuring curl.

FIG. 8 shows a diagram representing the relationship between the amount of a lift of an edge of the sheet 18 and the amount of a bend of the leading end 18*a* of the sheet 18. FIG. 9 shows a diagram representing the relationship between the amount of a bend of the leading end 18*a* and the output signal of the web displacement measuring unit 56. The amount of a bend of the leading end 18*a* is calculated from the diagram shown in FIG. 9, the height at which the web displacement measuring unit 56 is installed, and the output signal of the web displacement measuring unit 56. The amount of a lift of an edge of the sheet 18, i.e., the amount of curl of the web 12, is calculated from the diagram shown in FIG. 8.

When a line operation signal from the line operation signal supply unit 72 is supplied to the processor 70, width information from the product information supply unit 68 is supplied from the processor 70 to the processor 64. Based on the supplied width information, the processor 64 selects those of the web displacement measuring elements 56*a*~56*h* which will be used to measure a displacement of the web 12.

In the first embodiment, product sheets 18 have a width of 1030 mm, and the web displacement measuring elements 56*b*, 56*d*, 56*e*, 56*g* are used. As shown in FIG. 5, the web displacement measuring unit 56 is horizontally spaced 100 mm from a home position, indicated by the solid lines, of the running shear 20 in the direction indicated by the arrow A toward the conveyor 26, and is upwardly spaced 130 mm from the upper surface of the conveyor 26.

The unwinder 16 starts to unwind the web 12 at a speed of 20 m/min., thereby starting to operate the production line in the web cutting apparatus 10. The unwound web 12 is delivered over the roller 30 to the decurling unit 28. As shown in FIG. 2, the web 12 is decurled by the decurl rollers 22*a*–32*d* of the decurling unit 28, and then fed over the roller 40 and through the feed rollers 42 to the slitter 44.

As shown in FIG. 4, the slitter 44 cuts off opposite marginal sides of the web 12 with the slitter blades 45, reducing the width of the web 12 to a width of 1030 mm. Then, the web 12 is cut by the lower and upper blades 46, 48 of the running shear 20 successively into sheets 18 each having a length of 800 mm.

Figure 10A:
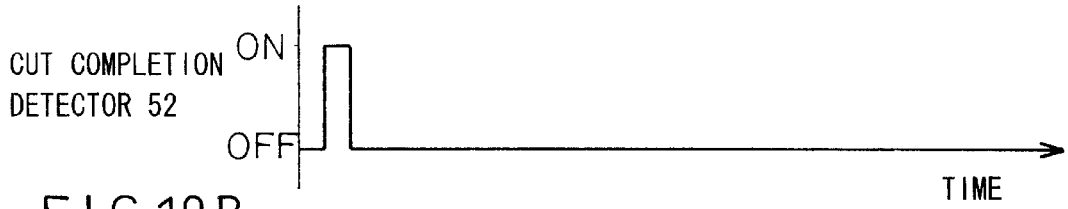
FIG. 10A is a timing chart of the output signal of a cut completion detector at an unwinding speed of 20 m/min.
Figure 10B:
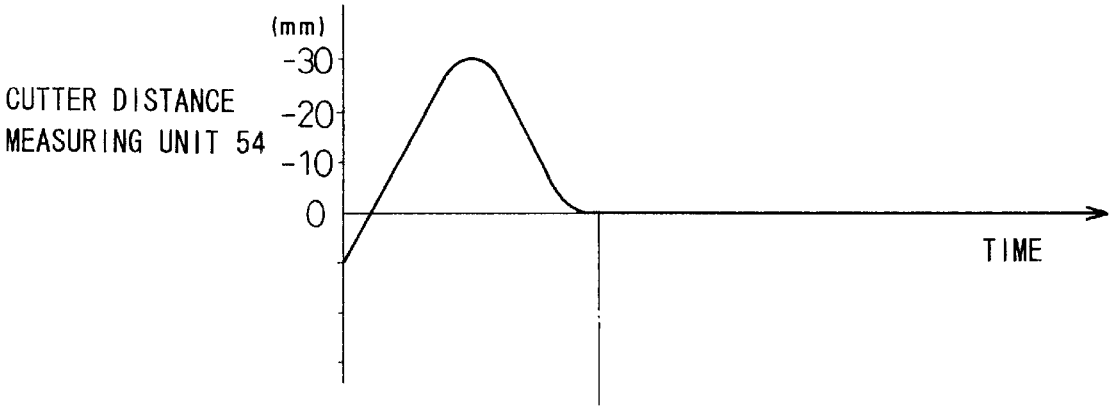
FIG. 10B is a timing chart of the output signal of a cutter distance measuring unit at an unwinding speed of 20 m/min.
Figure 10C:
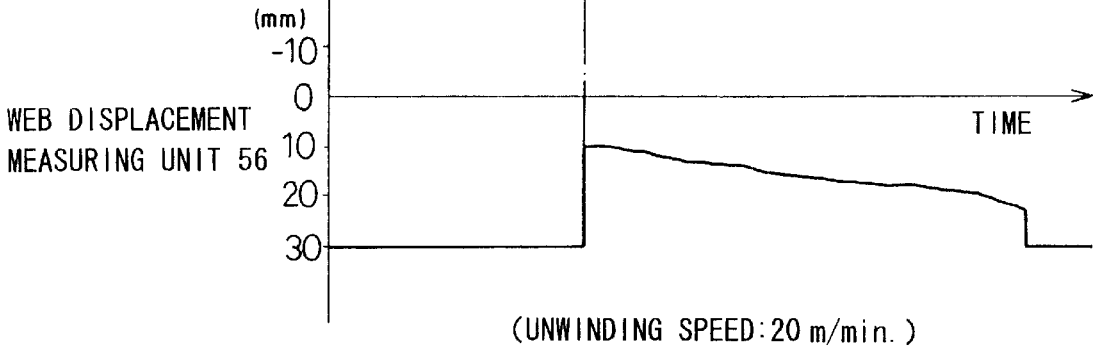
FIG. 10C is a timing chart of the output signal of the web displacement measuring unit at an unwinding speed of 20 m/min.

The cut completion detector 52, the cutter distance measuring unit 54, and the web displacement measuring unit 56 output respective signals as shown in FIGS. 10A through 10C. In FIG. 10B, the distance of 0 mm represents the home position of the running shear 20, distances represented by negative values indicate that the running shear 20 is displaced from the home position toward the conveyor 26, and distances represented by positive values indicate that the running shear 20 is displaced from the home position toward the slitter 44.

When the output signal from the cut completion detector 52 is turned on (ON), the processor 64 reads the output signal from the web displacement measuring unit 56 and the output signal from the cutter distance measuring unit 54 for a certain period of time. The output signal from the web displacement measuring unit 56 exhibits a sharp rise when the leading end 12*a* of the web 12 moves across the laser beams emitted by the web displacement measuring unit 56. Therefore, the processor 64 detects such a sharp rise of the output signal from the web displacement measuring unit 56 as data indicative of the leading end 12*a* of the web 12.

At the same time that the processor 64 reads output signal from the web displacement measuring unit 56, it reads the output signal from the cutter distance measuring unit 54 as indicating the position of the running shear 20 at the time. As shown in FIG. 10B, when the amount of a bend of the leading end 12*a* of the web 12 is measured, the running shear 20 is being held in the home position, and the output signal from the cutter distance measuring unit 54 represents the distance of 0 mm.

Figures 11A, 11B, 11C:
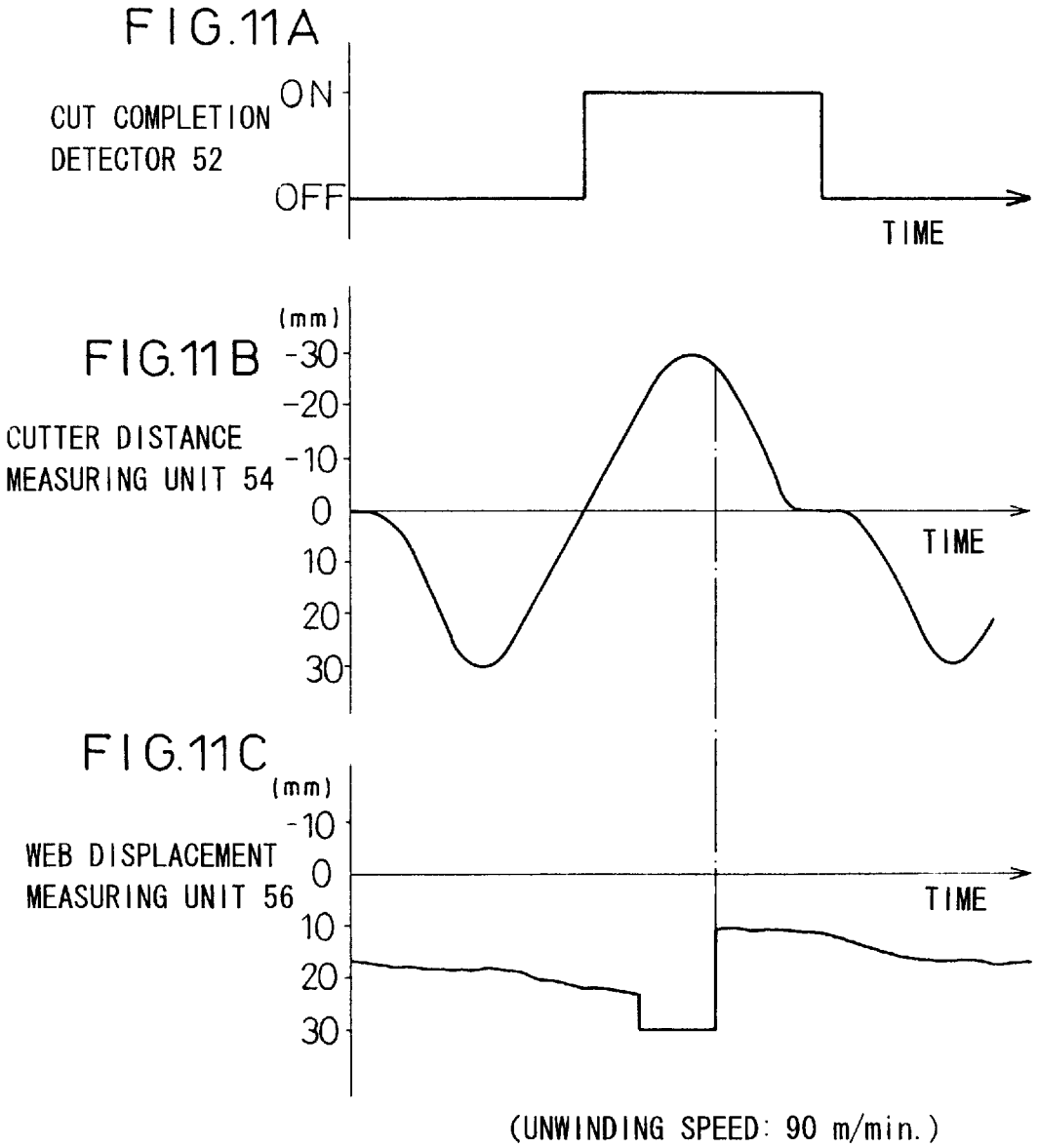
FIG. 11A is a timing chart of the output signal of the cut completion detector at an unwinding speed of 90 m/min.
FIG. 11B is a timing chart of the output signal of the cutter distance measuring unit at an unwinding speed of 90 m/min.
FIG. 11C is a timing chart of the output signal of the web displacement measuring unit at an unwinding speed of 90 m/min.

If the unwinder 16 unwinds the web 12 at a speed of 90 m/min., then cut completion detector 52, the cutter distance measuring unit 54, and the web displacement measuring unit 56 output respective signals as shown in FIGS. 11A through 11C. In this case, when the amount of a bend of the leading end 12*a* of the web 12 is measured, the running shear 20 is being displaced from the home position toward the conveyor 26. Therefore, since the distance from the web displacement measuring unit 56 to the running shear 20 is shorter when the data of the leading end 12*a* of the web 12 are read, it is necessary to calculate the amount of a bend of the leading end 12*a* of the web 12 based on a change in the distance from the fulcrum of the cut sheet 18 to the leading end 18*a* thereof.

Specifically, the relationship between the distance from the fulcrum and the amount of a bend of the leading end 12*a* of the web 12 is measured beforehand, and the distance between the cut completion detector 52 and the running shear 20 at the time of measuring the amount of a bend of the leading end 12*a* of the web 12 is calculated from the output signal Y(0) of the cutter distance measuring unit 54 when the running shear 20 is in the home position and the output signal Y(90) of the cutter distance measuring unit 54 when the web 12 is unwound at the speed of 90 m/min. Then, the amount X of a bend of the leading end 12*a* of the web 12 is calculated, using the calculated distance, the distance from the fulcrum, and the diagram with respect to the amount of a bend of the leading end 12*a* of the web 12.

More simply, the amount X of a bend of the leading end 12*a* of the web 12 may be calculated from the amount X(90) of a bend of the leading end 12*a* of the web 12 at the time the web 12 is unwound at the speed of 90 m/min. according to the following equation (1):

$$X=X(90)\times 100\div(100-Y(0)+Y(90))-\Delta H \quad (1)$$

In the case where the lower blade 46 of the running shear 20 is vertically swung, the distance up to the running shear 20 is measured by the cutter distance measuring unit 54, and the amount X of a bend of the leading end 12*a* of the web 12 may be calculated using a difference ΔH between the height of the lower blade 46 in the home position and the height of the lower blade 46 when the amount of a bend of the leading end 12*a* of the web 12 is measured, according to the following equation (2):

$$X=X(90)\times 100\div(100-Y(0)+Y(90))-\Delta H \quad (2)$$

Thereafter, the processor 70 calculates the amount of curl of the web 12 based on the calculated amount X of a bend of the leading end 12*a* of the web 12 and the diagram (see FIG. 8) showing the relationship between the amount of curl of the web 12 and the amount of a bend of the leading end thereof. The processor 70 is supplied with signals from the control units 38*a*–38*d* through the input/output interface 84, and displays the calculated amount of curl of the web 12 and settings for the decurl rollers 32*b*, 32*c* on the display unit 78 through the output interface 82.

The operator of the web cutting apparatus 10 can now confirm the amount of curl of the web 12 and the settings for the decurl rollers 32*b*, 32*c*. If the operator wishes to change the amount of curl of the web 12, then he can change the settings for the decurl rollers 32*b*, 32*c* while confirming the amount of curl. Accordingly, it is possible for the operator to adjust the amount of curl of the web 12 accurately within a certain range at all times.

Figure 12:
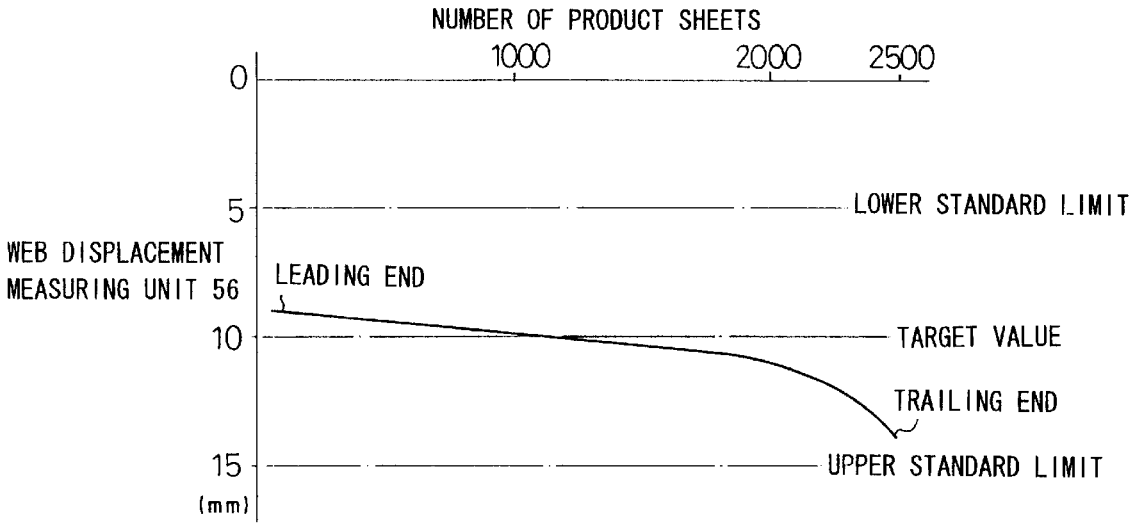
FIG. 12 is a diagram showing how the output signal of the web displacement measuring unit varies from the start to the end of a web unwinding process.
Figure 13:
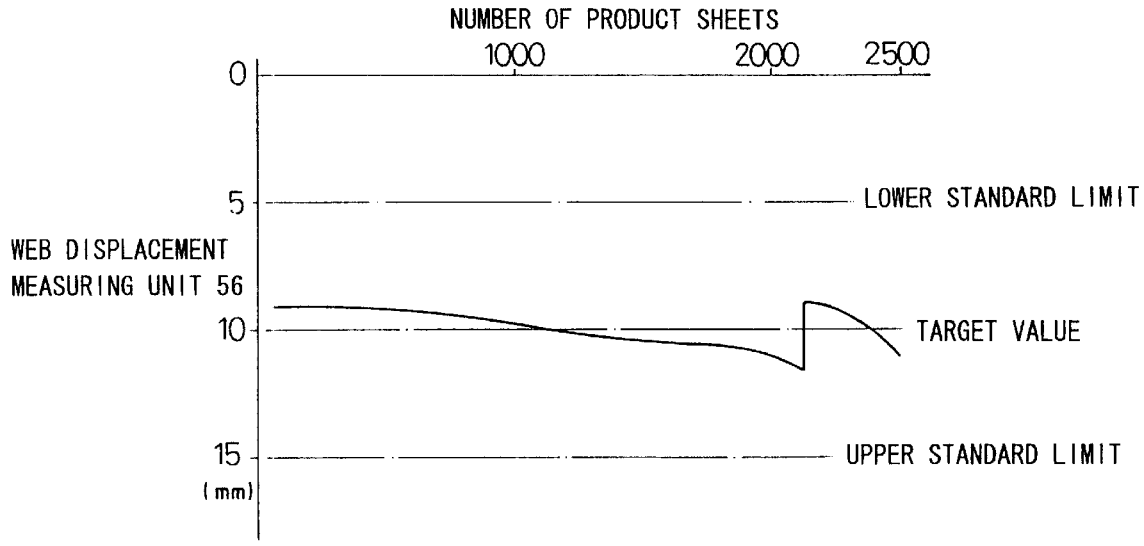
FIG. 13 is a diagram showing the output signal of the web displacement measuring unit at the time settings of a curl correcting unit are modified.

FIG. 12 shows how the output signal of the web displacement measuring unit 56 varies from the start to the end of a process of unwinding the web 12 from the reel 14. As seen FIG. 12, as the unwound web 12 approaches its trailing end, the amount of curl of the web 12 increases, and the output signal from the web displacement measuring unit 56 changes greatly.

By changing the settings for the decurl rollers 32*b*, 32*c* depending on the calculated amount of curl of the web 12, it is possible to produce sheets 18 whose amount of curl remains close to a target value throughout the entire length of the web 12. Consequently, all the sheets 18 cut from the web 12 can maintain stable quality effectively.

When all the sheets 18 are stacked in the stacker station 24 and the production process comes to an end, the line operation signal supply unit 72 applies a stop signal to the processor 70. The operating conditions of the web cutting apparatus 10 supplied from the line operation condition supply unit 74, the product information supplied from the product information supply unit 68, the settings for the decurl rollers 32*b*, 32*c*, and the amount of curl calculated by the processor 70 are stored in the memory 76.

When another web 12 for producing into new presensitized plates is to be unwound and cut into sheets 18, therefore, the settings for the decurling unit 28 may be changed to desired settings based on the information stored in the memory 76 and the product information about the web 12. Since it is not necessary to operate the decurling unit 28 with provisional settings, the web cutting apparatus 10 can produce sheets 18 each with a desired amount of curl according to product specifications immediately after the web cutting apparatus 10 has started operating. Consequently, the yield of sheets 18 is improved, the time in which to operate the web cutting apparatus 10 at a low speed is greatly reduced, and the efficiency of production is effectively increased. An actual run from the web cutting apparatus 10 experienced an increase of about 5%.

Figure 14:
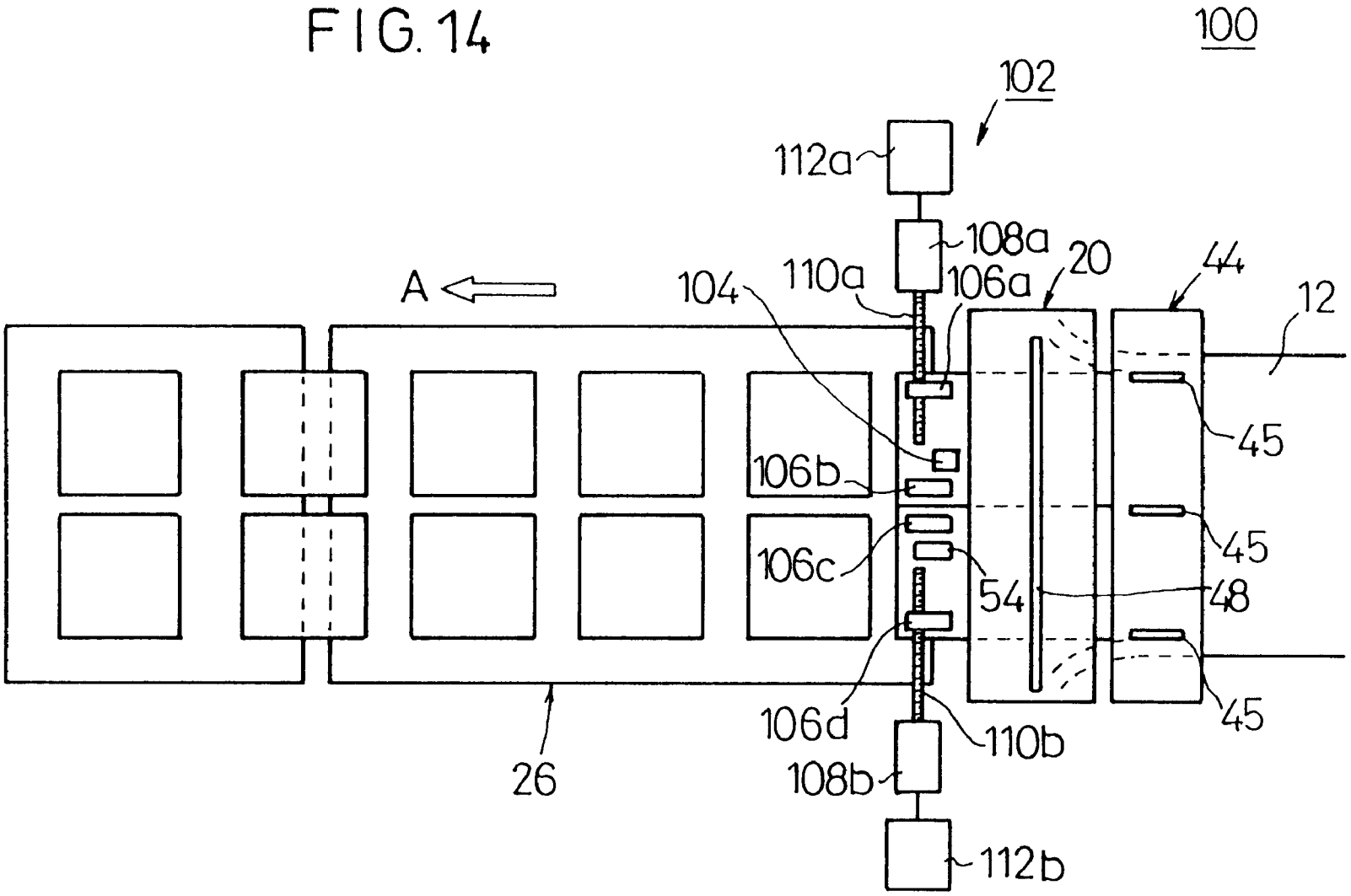
FIG. 14 is a plan view of a web cutting apparatus according to a second embodiment of the present invention.

FIG. 14 shows a web cutting apparatus 100 according to a second embodiment of the present invention. The web cutting apparatus 100 serves to cut a web 12 having a width of 1310 mm into two rows of sheets each having a width of 650 mm and a length of 550 mm. Those parts of the web cutting apparatus which are identical to those of the web cutting apparatus 10 are denoted by identical reference numerals, and will not be described in detail below.

The web cutting apparatus 100 has a curl measuring unit 102 which comprises a web leading end detector (web leading end detecting mechanism) 104 in place of the cut completion detector 52, and a plurality of displacement measuring elements 106*a*–106*d* arranged symmetrically respect to the center of the direction in which the web 12 is delivered. The web leading end detector 104 may comprise a photoelectric switch as with the cut completion detector 52.

Figure 15:
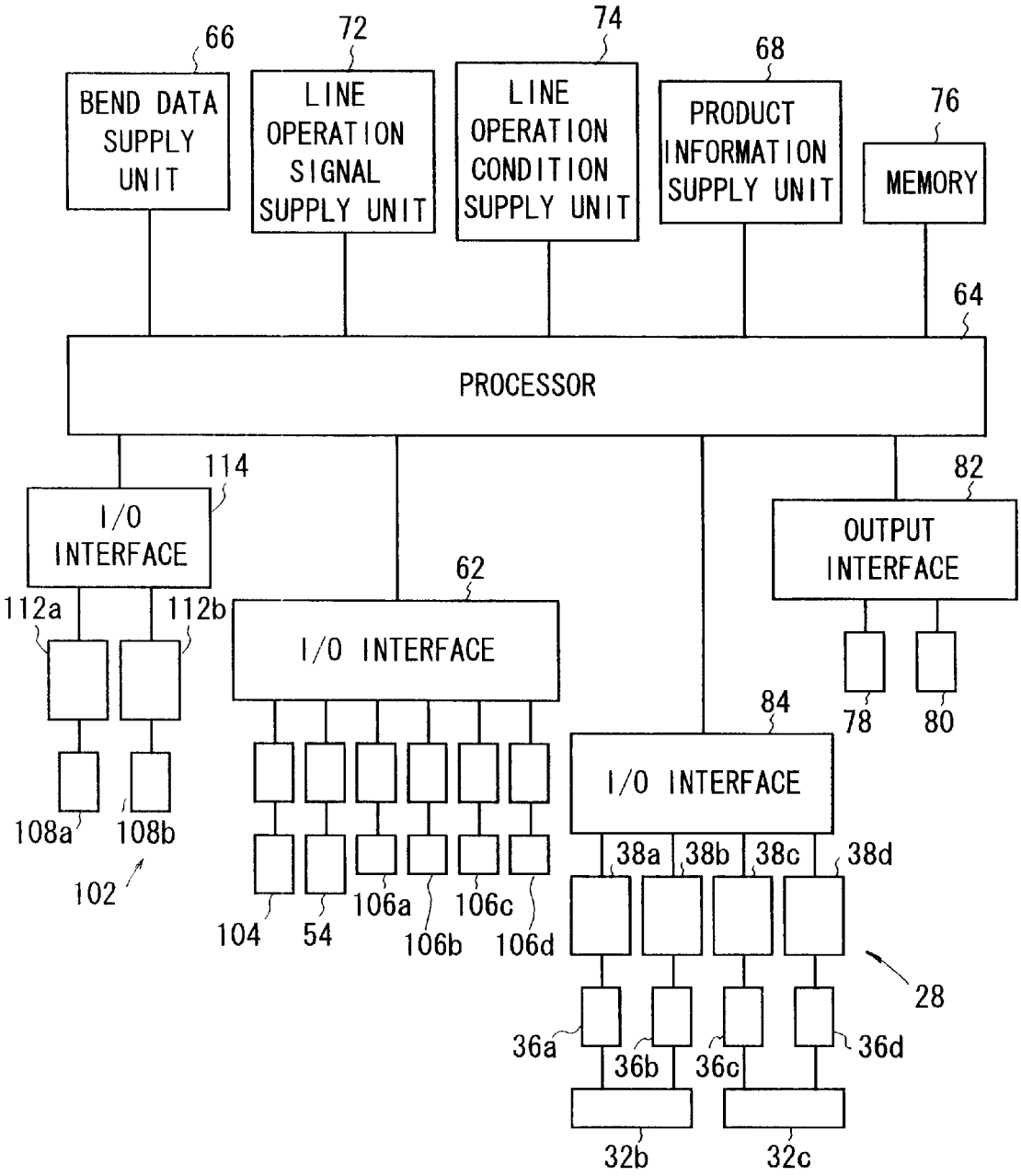
FIG. 15 is a block diagram of a control system for the web cutting apparatus according to the second embodiment.

The displacement measuring elements 106*a,* 106*d* are threaded over respective ball screws 110*a,* 110*b* with outer ends coupled to respective drive mechanisms such as motors 108*a,* 108*b*. Therefore, the displacement measuring elements 106*a,* 106*d* can be moved back and forth transversely across the web 12 by the respective ball screws 110*a,* 110*b*. The motors 108*a,* 108*b* are controlled by respective control units 112*a,* 112*b*. As shown in FIG. 15, the control units 112*a,* 112*b* are electrically connected through an input/output interface 114 to the processor 64. The processor 70 according to the first embodiment is not included in the control system shown in FIG. 15.

The distance between the displacement measuring elements 106*b,* 106*d* is set to 60 mm. When drive signals are supplied from the processor 64 through the input/output interface 114 to the motors 108*a,* 108*b* based on product information supplied from the production information supply unit 64 and a line operation signal supplied from the line operation signal supply unit 72, the displacement measuring elements 106*a,* 106*d* are displaced transversely across the web 12 until they are spaced from each other by a distance of 1240 mm.

Figure 16A:
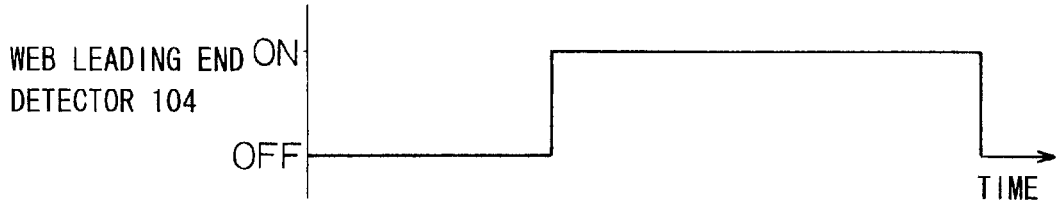
FIG. 16A is a timing chart of the output signal of a web leading end detector of the web cutting apparatus according to the second embodiment.
Figure 16B:
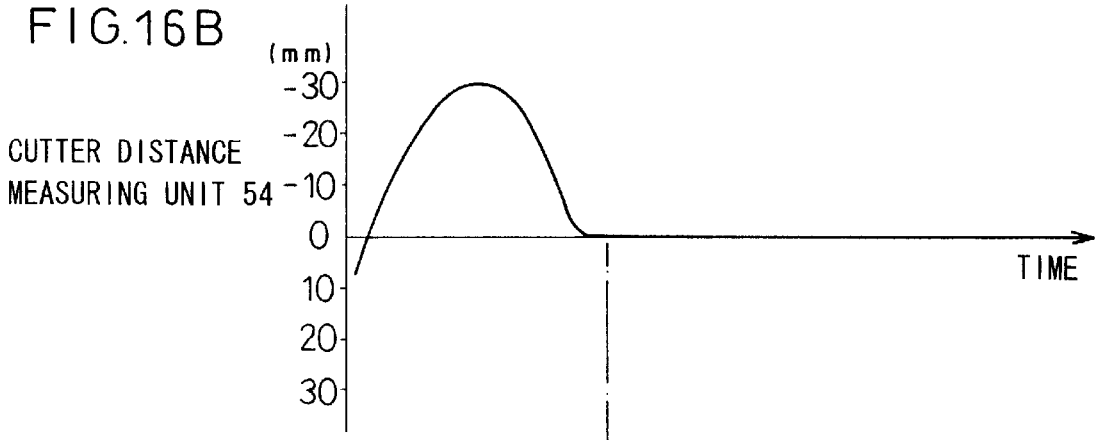
FIG. 16B is a timing chart of the output signal of a cutter distance measuring unit of the web cutting apparatus according to the second embodiment.
Figure 16C:
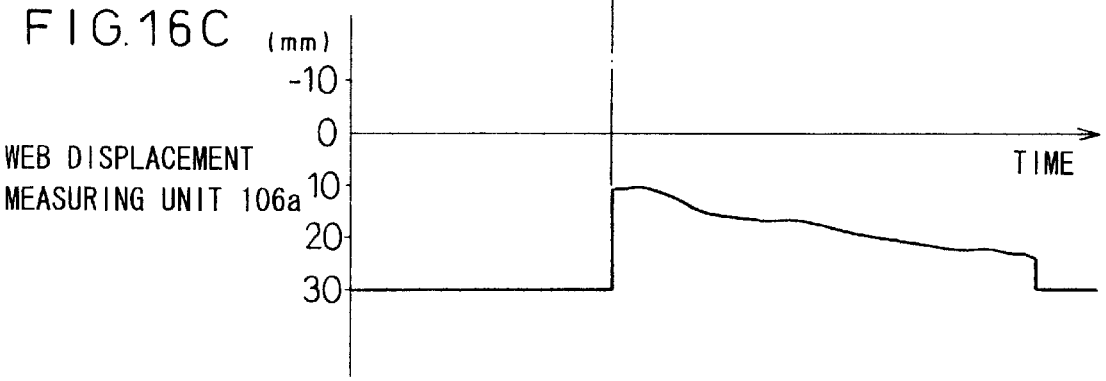
FIG. 16C is a timing chart of the output signal of a web displacement measuring unit of the web cutting apparatus according to the second embodiment.

When the web 12 is then unwound from the reel at a speed of 20 m/min., the web leading end detector 104, the cutter distance measuring unit 54, and the displacement measuring element 106*a* output respective signals as shown in FIGS. 16A~16C. Therefore, as with the first embodiment which employs the cut completion detector 52, it is possible to calculate the amount of curl from the amount of a bend of the leading end 12*a* of the web 12.

In the second embodiment, the single processor 64 is sufficiently capable of performing desired functions insofar as the unwinding speed is relatively low and the number of sheets cut from the web 12 is relatively small.

Figure 17:
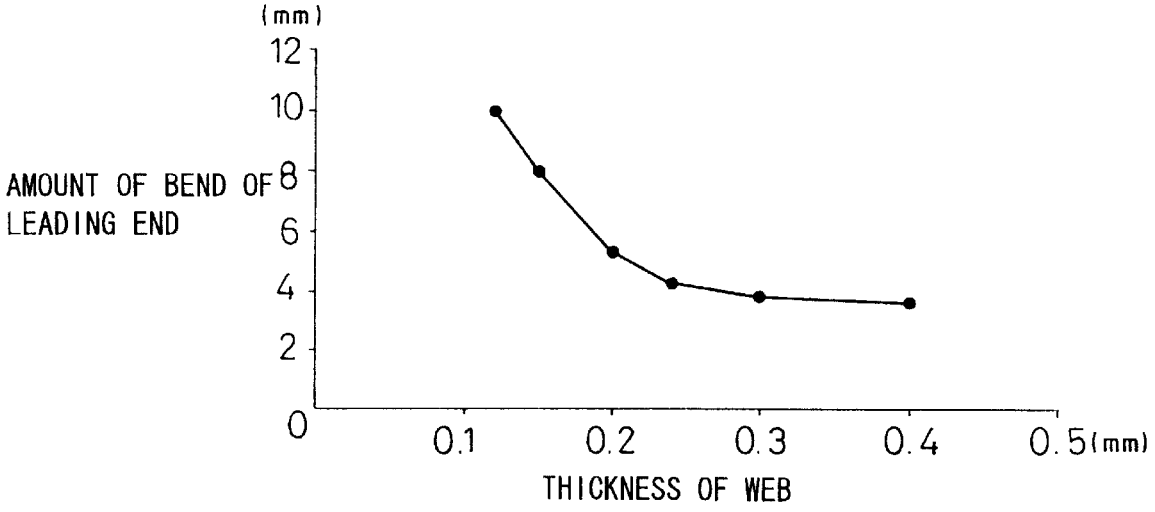
FIG. 17 is a diagram showing the relationship between the thickness of a web and the amount of a bend of a leading end of the web with respect to a thin metal sheet whose amount of a lift is 0 (zero).

When the thickness of a thin metal sheet for use as a presensitized plate is changed, the amount of a bend of the leading end 12*a* of the web 12 is also changed. FIG. 17 shows the relationship between the thickness of a web and the amount of a bend of a leading end of the web with respect to a thin metal sheet whose amount of a lift is 0 (zero). It can be understood from FIG. 17 that the amount of a bend of the leading end decreases as the thickness of the web increases.

Therefore, it is preferable to draw up the diagrams shown in FIGS. 8 and 9 in advance with respect to various web thicknesses, and also with respective to various materials of the thin metal sheet. If the data of the amount of a bend of the leading end with respect to various web thicknesses and materials are stored in the memory 76 and selected depending on the product information supplied from the product information supply unit 68, then it is possible to manufacture various sheet products very efficiently with a good yield.

Although certain preferred embodiments of the present invention have been shown and described in detail, it should be understood that various changes and modifications may be made therein without departing from the scope of the appended claims.

What is claimed is:

1. A method of measuring curl of a web which is longitudinally fed without being subject to tension, comprising the steps of:

detecting a displacement due to a bend of a free distal end of the web;

detecting the position of a web cutter, for cutting the web, when the displacement due to the bend of the free distal end of the web is detected, wherein the detected position of the web cutter is relative to the position of the free distal end of the web; and calculating the amount of curl of said web based on the detected displacement due to the bend of the free distal end and the detected position of the web cutter.

2. A method according to claim 1, wherein the amount of curl of said web is calculated based on product information including the thickness of said web, the detected displacement due to the bend of the free distal end, and the detected position of the web cutter.

3. A method of measuring curl of a web which is longitudinally fed without being subject to tension, comprising the steps of:

establishing a relationship between the amount of curl of said web and the amount of a bend of a free distal end of the web;

detecting a displacement due to the bend of said free distal end;

detecting the position of a web cutter for cutting the web when the displacement due to the bend of the free distal end of the web is detected, wherein the detected position of the web cutter is relative to the distal end of the web; and calculating the amount of curl of said web based on the detected displacement due to the bend of the free distal end, the detected position of the web cutter, and said established relationship.

4. An apparatus for measuring curl of a web which is longitudinally fed without being subject to tension, comprising:

a cut completion detecting mechanism for detecting when the web is cut by a web cutter;

a cutter distance measuring mechanism for detecting the position of said web cutter relative to a free distal end of the web; and a web displacement measuring mechanism for detecting a displacement due to a bend of the free distal end of the web as a change in the distance up to a surface of said web.

5. An apparatus according to claim 4, further comprising a processor for calculating the amount of curl of said web based on a detected signal from said cut completion detecting mechanism, a detected signal from said cutter distance measuring mechanism, a detected signal from said web displacement measuring mechanism, and product information including the thickness of said web.

6. An apparatus according to claim 5, further comprising a bend calculating processor for calculating the amount of the bend of said web based on the detected signal from said cut completion detecting mechanism, the detected signal from said cutter distance measuring mechanism, and the detected signal from said web displacement measuring mechanism, said processor comprising means for calculating the amount of curl of said web based on the amount of the bend calculated by said bend calculating processor, bend data representative of a relationship measured in advance between the amount of the bend of the free distal end and the amount of curl of the web, and the product information including the thickness of said web.

7. An apparatus according to claim 4, wherein said web displacement measuring mechanism comprises a plurality of web displacement measuring elements arrayed transversely across said web.

8. An apparatus according to claim 4, wherein said web displacement measuring mechanism includes drive means for moving the web displacement measuring mechanism transversely across said web.

9. An apparatus for measuring curl of a web which is longitudinally fed without being subject to tension, comprising:

a web leading end detecting mechanism for detecting a free leading end of the web;

a cutter distance measuring mechanism for detecting the position of a web cutter for cutting the web wherein the detected position of the web cutter is relative to said free distal end of the web; and a web displacement measuring mechanism for detecting a displacement due to a bend of said free distal end as a change in the distance up to a surface of said web.

10. An apparatus according to claim 9, further comprising a processor for calculating the amount of curl of said web based on a detected signal from said web leading end detecting mechanism, a detected signal from said cutter distance measuring mechanism, a detected signal from said web displacement measuring mechanism, and product information including the thickness of said web.

11. An apparatus according to claim 9, wherein said web displacement measuring mechanism comprises a plurality of web displacement measuring elements arrayed transversely across said web.

12. An apparatus according to claim 9, wherein said web displacement measuring mechanism includes drive means for moving the web displacement measuring mechanism transversely across said web.

13. A method of correcting curl of a web which is longitudinally fed without being subject to tension, comprising the steps of:

detecting a displacement due to a bend of a free distal end of the web;

detecting the position of a web cutter for cutting the web when the displacement due to the bend of the free distal end of the web is detected, wherein the detected position of the web cutter is relative to the free distal end of the web;

calculating the amount of curl of said web based on product information including the thickness of said web, the detected displacement due to the bend of the free distal end, and the detected position of the web cutter; and changing settings for a curl correcting unit for correcting curl of said web based on the calculated amount of curl of said web.

14. A method of correcting curl of a web which is longitudinally fed without being subject to tension, comprising the steps of:

establishing a relationship between the amount of curl of the web and the amount of a bend of a free distal end of the web;

detecting a displacement due to the bend of the free distal end of the web;

detecting the position of a web cutter for cutting the web when the displacement due to the bend of the free distal end of the web is detected;

calculating the amount of curl of said web based on product information including the thickness of said web, the detected displacement due to the bend of the free distal end, the detected position of the web cutter, and the established relationship; and changing settings for a curl correcting unit for correcting curl of said web based on the calculated amount of curl of said web.

15. A method of correcting curl of a second web which is longitudinally fed without being subject to tension, comprising the steps of:

storing data representing the amount of curl of a first web, product information including the thickness of said first web, and settings for a curl correcting unit for correcting curl of said first web; and calculating settings for the curl correcting unit based on the stored data and product information of said second web to be processed.

16. An apparatus for correcting curl of a second web which is longitudinally fed without being subject to tension, comprising:

memory means for storing data representing the amount of curl of a first web, product information including the thickness of said first web, and settings for a curl correcting unit for correcting curl of said first web; and a processor for calculating settings for the curl correcting unit based on the stored data and product information of said second web to be processed.

17. An apparatus according to claim 16, further comprising:

drive mechanisms for changing the settings for the curl correcting unit based on the settings calculated by said processor; and control mechanisms for controlling said drive mechanisms.

18. An apparatus for cutting a web, comprising:

a reel carrying a roll of web thereon;

a cutter for cutting the web unwound from said reel into a sheet having a predetermined length;

a curl measuring unit disposed immediately proximate an exit end of said cutter for detecting the amount of curl of said web based on a displacement due to a bend of a free distal end of the web; and a feed mechanism for feeding said sheet to a stacking position, wherein said curl measuring unit comprises:

a cut completion detecting mechanism for detecting when the web is cut by said cutter;

a cutter distance measuring mechanism for detecting the position of said cutter; and a web displacement measuring mechanism for detecting the displacement due to the bend of the free distal end of the web as a change in the distance up to a surface of said web.

19. An apparatus for cutting a web, comprising:

a reel carrying a roll of web thereon;

a cutter for cutting the web unwound from said reel into a sheet having a predetermined length;

a curl measuring unit disposed immediately proximate an exit end of said cutter for detecting the amount of curl of said web based on a displacement due to a bend of a free distal end of the web; and a feed mechanism for feeding said sheet to a stacking position, wherein said curl measuring unit comprises:

a web leading end detecting mechanism for detecting the free leading end of the web;

a cutter distance measuring mechanism for detecting the position of said cuter for cutting the web; and a web displacement measuring mechanism for detecting the displacement due to the bend of said free distal end as a change in the distance up to a surface of said web.

20. An apparatus for cutting a web, comprising:

a reel carrying a roll of web thereon;

a cutter for cutting the web unwound from said reel into a sheet having a predetermined length;

a curl measuring unit disposed immediately proximate an exit end of said cutter for detecting the amount of curl of said web based on a displacement due to a bend of a free distal end of the web;

a feed mechanism for feeding said sheet to a stacking position; and a curl correcting unit disposed between said reel and said cutter for correcting curl of said web unwound from said reel, wherein said curl correcting unit comprises;

memory means for storing data representing product information including the thickness of said web, the amount of curl of the web, and settings for the curl correcting unit;

a processor for calculating settings for the curl correcting unit based on the stored data and product information of a net web to be processed;

drive mechanisms for changing the settings for the curl correcting unit based on the settings calculated by said processor; and control mechanisms for controlling said drive mechanisms.

* * * * *